US009058003B2

(12) United States Patent
Tanaka et al.

(10) Patent No.: US 9,058,003 B2
(45) Date of Patent: Jun. 16, 2015

(54) IMAGE FORMING APPARATUS

(71) Applicants: Kayoko Tanaka, Tokyo (JP); Keita Sone, Kanagawa (JP)

(72) Inventors: Kayoko Tanaka, Tokyo (JP); Keita Sone, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/203,902

(22) Filed: Mar. 11, 2014

(65) Prior Publication Data

US 2014/0294412 A1 Oct. 2, 2014

(30) Foreign Application Priority Data

Mar. 27, 2013 (JP) ..... 2013-066038

(51) Int. Cl.
*G03G 15/00* (2006.01)

(52) U.S. Cl.
CPC .. *G03G 15/5058* (2013.01); *G03G 2215/00059* (2013.01); *G03G 2215/0132* (2013.01); *G03G 2215/0161* (2013.01); *G03G 2215/0164* (2013.01)

(58) Field of Classification Search
CPC ..... G03G 15/04027; G03G 15/5054; G03G 15/5058; G03G 2215/00059
USPC ..... 399/49, 72, 301
See application file for complete search history.

(56) References Cited

U.S. PATENT DOCUMENTS 5,177,530 A * 1/1993 Takano ..... 399/9
6,185,386 B1 * 2/2001 Noguchi ..... 399/49
2002/0089579 A1 7/2002 Yamanaka et al.
2003/0137577 A1 * 7/2003 Shinohara ..... 347/134
2005/0214005 A1 * 9/2005 Tokuyama et al. ..... 399/49
2006/0002724 A1 1/2006 Fujimori et al.
2006/0233561 A1 * 10/2006 Yamaoka ..... 399/49
2007/0019976 A1 1/2007 Watanabe et al.
2007/0071469 A1 * 3/2007 Ravitz ..... 399/49
2007/0116480 A1 5/2007 Takeuchi et al.
2007/0122168 A1 5/2007 Tanaka et al.
2008/0205923 A1 8/2008 Takeuchi et al.
2008/0253793 A1 10/2008 Ishibashi et al.
2008/0317486 A1 * 12/2008 Monma et al. ..... 399/45
2009/0202263 A1 8/2009 Yoshida et al.
2011/0052239 A1 3/2011 Tanaka et al.
2013/0236200 A1 9/2013 Tanaka et al.

FOREIGN PATENT DOCUMENTS

JP 2002-207337 7/2002
JP 2006-293240 10/2006
JP 2010-015110 1/2010

* cited by examiner

*Primary Examiner* — Benjamin Schmitt
(74) *Attorney, Agent, or Firm* — Oblon, McClelland, Maier & Neustadt, L.L.P.

(57) ABSTRACT

An image forming apparatus includes an image bearer, a toner image forming unit, a detector, and a controller to adjust an image forming condition based on a detection result by the detector. During a non-printing period, multiple toner patterns are formed in an end and center portions of the image bearer in a direction perpendicular to a direction in which the image bearer moves, and a smaller number of toner patterns selected from the multiple toner patterns are formed in a non-image area, in the end portion of the image bearer, during a printing period. The controller determines a target density X of the smaller number of toner patterns by X=H (a mean detected density of the multiple toner patterns formed in the end portion)×J (a predetermined reference value)/I (a mean detected density of the multiple toner patterns formed in the end portion and in the center portion).

11 Claims, 13 Drawing Sheets

CYAN

BLACK

IMAGE FORMING APPARATUS

CROSS-REFERENCE TO RELATED APPLICATION

This patent application is based on and claims priority pursuant to 35 U.S.C. §119 to Japanese Patent Application No. 2013-066038, filed on Mar. 27, 2013, in the Japan Patent Office, the entire disclosure of which is hereby incorporated by reference herein.

BACKGROUND OF THE INVENTION

1. Technical Field

Embodiments of this invention generally relate to an electrophotographic image forming apparatus, such as a copier, a printer, a facsimile machine, and a multifunction peripheral (MFP) having at least two of coping, printing, facsimile transmission, plotting, and scanning capabilities.

2. Description of the Background Art

In image forming apparatuses such as printers, facsimile machines, and copiers, fluctuations in image density and color deviation arise due to environmental changes over time. Accordingly, typically, toner patterns for measurement are formed on a transfer belt, and the density and position thereof are detected.

JP-2002-207337-A proposes, at power-on time or when the number of output sheets reaches a predetermined number, forming multiple toner patterns for positional deviation adjustment on the transfer belt and adjusting positions of yellow, magenta, cyan, and black toner images. Density adjustment of respective color toner image forming units can be performed in a similar manner.

Additionally, JP-2006-293240-A proposes forming a toner pattern in a non-image area for density adjustment during formation of output images.

SUMMARY OF THE INVENTION

In view of the foregoing, one embodiment of the present invention provides an image forming apparatus that includes an image bearer, a toner image forming unit including a developing device provided with a developing roller, a detector to detect a toner pattern formed on the image bearer, and a controller to cause the toner image forming unit to form the toner pattern on the image bearer, cause the detector to detect the toner pattern, and adjust an image forming condition of the toner image forming unit based on a detection result generated by the detector.

During a non-printing period, the toner image forming unit forms multiple toner patterns and the detector detects densities of the multiple toner patterns, and, during a printing period, the toner image forming unit forms an output image in an image area and a smaller number of toner patterns in a non-image area. The toner patterns formed during the printing period are smaller in number than those formed during the non-printing period and selected from those formed during the non-printing period.

The multiple toner patterns formed during the non-printing period are formed in both of an end portion and a center portion of the image bearer in a direction perpendicular to a direction in which the image bearer moves, and the smaller number of toner patterns formed during the printing period are formed in the end portion of the image bearer. The controller determines a target density X of the smaller number of toner patterns formed during the printing period using a formula:

$$X=H\times J/I$$

wherein H represents a mean detected density of the multiple toner patterns formed in the end portion during the non-printing period, J represents a predetermined reference value, and I represents a mean detected density of the multiple toner patterns formed in the end portion and the multiple toner patterns formed in the center portion during the non-printing period.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
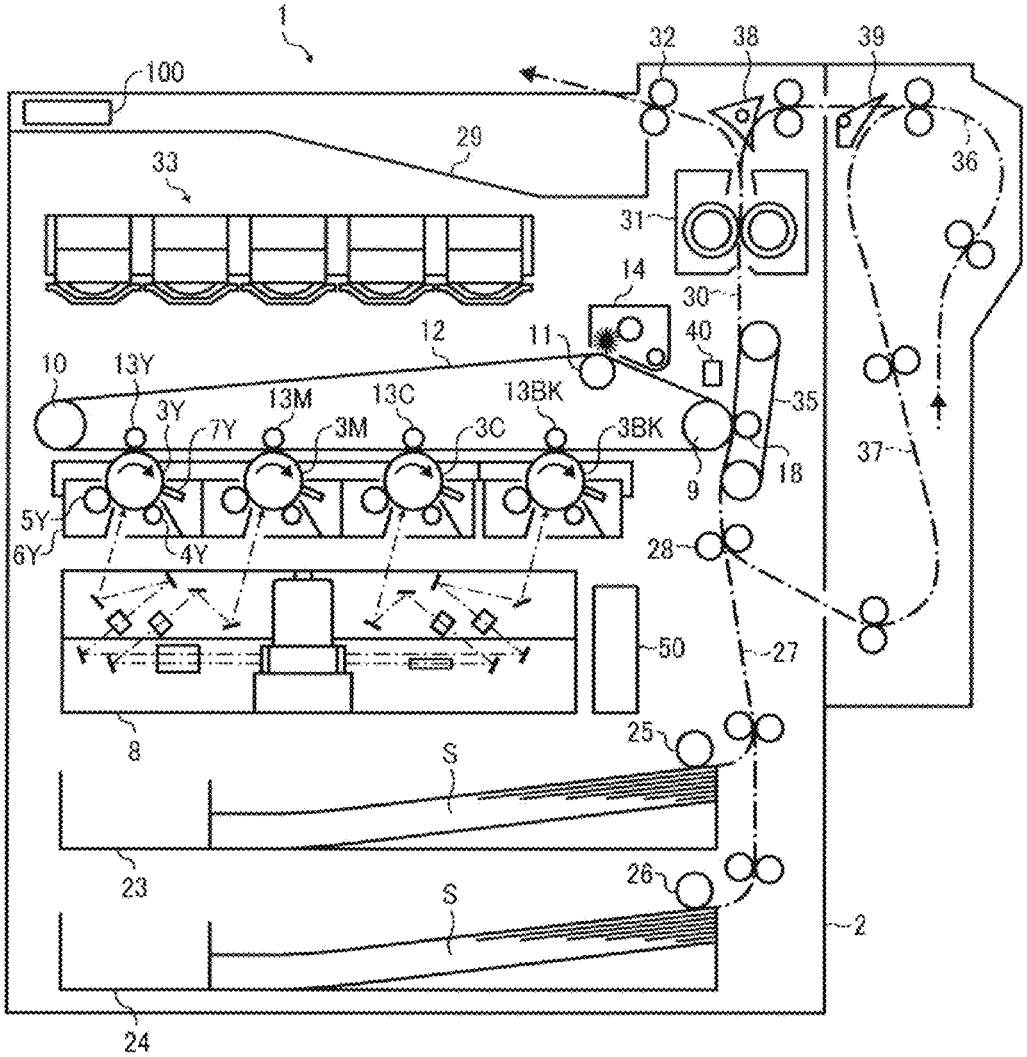
FIG. 1 is a cross-sectional view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In multicolor image forming apparatuses, each time a predetermined number of sheets are output, the following operations are widely performed to correct fluctuations in the density and the position thereof. Image output is prohibited, multiple toner patterns are formed on a transfer belt, and the density and the position of the toner patterns are detected.

In image forming apparatuses in which toner patterns are formed in parallel to image output, periods in which image output is unfeasible due to adjustments are not caused. In this case, however, the number of toner patterns is limited since the toner patterns are formed outside the image area. Accordingly, the accuracy of adjustment is rather rough, and the adjustment accuracy may be insufficient in full-color images in which gradation reliability is important.

Therefore, it is conceivable to combine the method of forming the toner patterns inside and outside the image area for adjusting image density while no images are output and the method of forming the toner patterns in parallel to image output, thereby stabilizing overall image quality.

Additionally, it is possible that image density is not fully adjusted for some reasons in the method of forming the toner patterns inside or outside the image area while no images are output. In that case, the image density is adjusted gradually to a target density using the method of forming the toner patterns outside the image area.

However, the inventors of the present invention have found that, when there are differences in image density between the image area and the outside thereof, it is possible that the image density is not adjusted to the target density in the method of forming the toner patterns outside the image area.

In view of the foregoing, an object of the embodiment described below is to control image density to a target value in the method of forming the toner patterns inside and outside the image area.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a cross-sectional view of a multicolor image forming apparatus 1 according to the present embodiment, which can be a multicolor printer, for example.

In a substantially center portion of an apparatus body 2 of the image forming apparatus 1, four drum-shaped photoreceptors 3Y, 3M, 3C, and 3BK are disposed horizontally, arranged at constant intervals in a lateral direction in FIG. 1.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary. It is to be noted that reference number 100 in FIG. 1 represents a control panel serving as an input device.

As a representative, the photoreceptor 3Y for yellow is described. The photoreceptor 3Y includes a cylindrical aluminum base having a diameter of within a range from 30 mm to 100 mm and a photosensitive organic semiconductor layer overlying the surface of the aluminum base, for example. In FIG. 1, the photoreceptor 3Y rotates clockwise as indicated by an arrow shown in FIG. 1. Around the lower side of the photoreceptor 3Y in FIG. 1, image forming components, namely, a charging roller 4Y, a developing device 6Y including a developing roller 5Y, and a cleaning unit 7Y are disposed in an clockwise order according to the sequence of electrostatic image forming processes. This configuration is similar to configurations around the photoreceptors 3M, 3C, and 3BK except that the color of toner used is different. It is to be noted that belt-shaped photoreceptors may be used instead.

Beneath the photoreceptors 3, the charging rollers 4, the developing devices 6, and the cleaning units 7, and an exposure device 8 is provided. The exposure device 8 scans uniformly charged surfaces of the photoreceptors 3 with laser beams according to respective color image data, thereby forming electrostatic latent images thereon. A long, narrow clearance (i.e., a slit) is secured between each charging roller 4 and the corresponding developing roller 5 so that the laser beam emitted from the exposure unit 8 can reach the photoreceptor 3. Although the exposure device 8 shown in FIG. 1 is a laser-scanning type device including a laser light source, a polygon mirror, and the like, alternatively, an exposure device in which a light-emitting diode (LED) array and an imaging element are combined may be used.

Above the photoreceptors 3, an intermediate transfer belt 12 is looped around multiple rollers 9, 10, and 11. The intermediate transfer belt 12 is rotatable counterclockwise in FIG. 1. The intermediate transfer belt 12 is common to the respective photoreceptors 3 and is disposed flat and substantially horizontally to contact a part of each photoreceptor 3 that has experienced image development. Four primary-transfer rollers 13 are provided on an inner circumferential side of the intermediate transfer belt 12 at positions facing the respective photoreceptors 3. A belt cleaning unit 14 is provided on an outer circumferential side of the intermediate transfer belt 12, for example, at a position facing the roller 11. The belt cleaning unit 14 removes toner remaining on the surface of the intermediate transfer belt 12. For example, the intermediate transfer belt 12 includes a resin film or rubber base having a thickness within a range of from 50 μm to 600 μm and has a resistance value at which the toner image formed on each photoreceptor 3 can be transferred onto the surface of the intermediate transfer belt 12. A toner image is formed on the intermediate transfer belt 12 by a toner image forming unit including the photoreceptor 3, the charging roller 4, and the developing device 6. The toner image is transferred by the primary-transfer roller 13 onto the intermediate transfer belt 12.

Multiple sheet trays (two sheet trays 23 and 24 in the configuration shown in FIG. 1) are disposed beneath the exposure unit 8 inside the apparatus body 2. The sheet trays 23 and 24 can be pulled out to a front side of the apparatus. Sheets S of recording media contained in the sheet trays 23 and 24 are selectively sent out as the corresponding one of feed rollers 25 and 26 rotate, and a paper feeding channel 27 extends substantially vertically to a transfer position. A conveyance belt 35 is provided on a side of the intermediate transfer belt 12. A secondary-transfer roller 18, serving as a secondary transfer member, is provided inside the loop of the conveyance belt 35 and faces the roller 9, one of the rollers supporting the intermediate transfer belt 12. The intermediate transfer belt 12 and the conveyance belt 35 are nipped between the secondary-transfer roller 18 and the roller 9, forming a secondary-transfer nip. A pair of registration rollers 28 is provided in the paper feeding channel 27, at a position immediately upstream from the transfer position in the direction in which the sheet S is transported, to adjust a timing at which the sheet S is sent to the transfer position. Additionally, a discharge channel 30 is formed above the transfer position. The discharge channel 30 is continuous with the paper feeding channel 27 and leads to a stack portion 29 formed on an upper face of the apparatus body 2. In the discharge channel 30, a fixing device 31 including a pair of fixing rollers and a pair of discharge rollers 32 are provided.

It is to be noted that, inside the apparatus body 2, a toner container mount 33 to accommodate toner containers for containing toner is provided in a space beneath the stack portion 29. Toner can be transported from the toner container mount 33 to the corresponding developing device 6 by a pump or the like.

Figure 4:
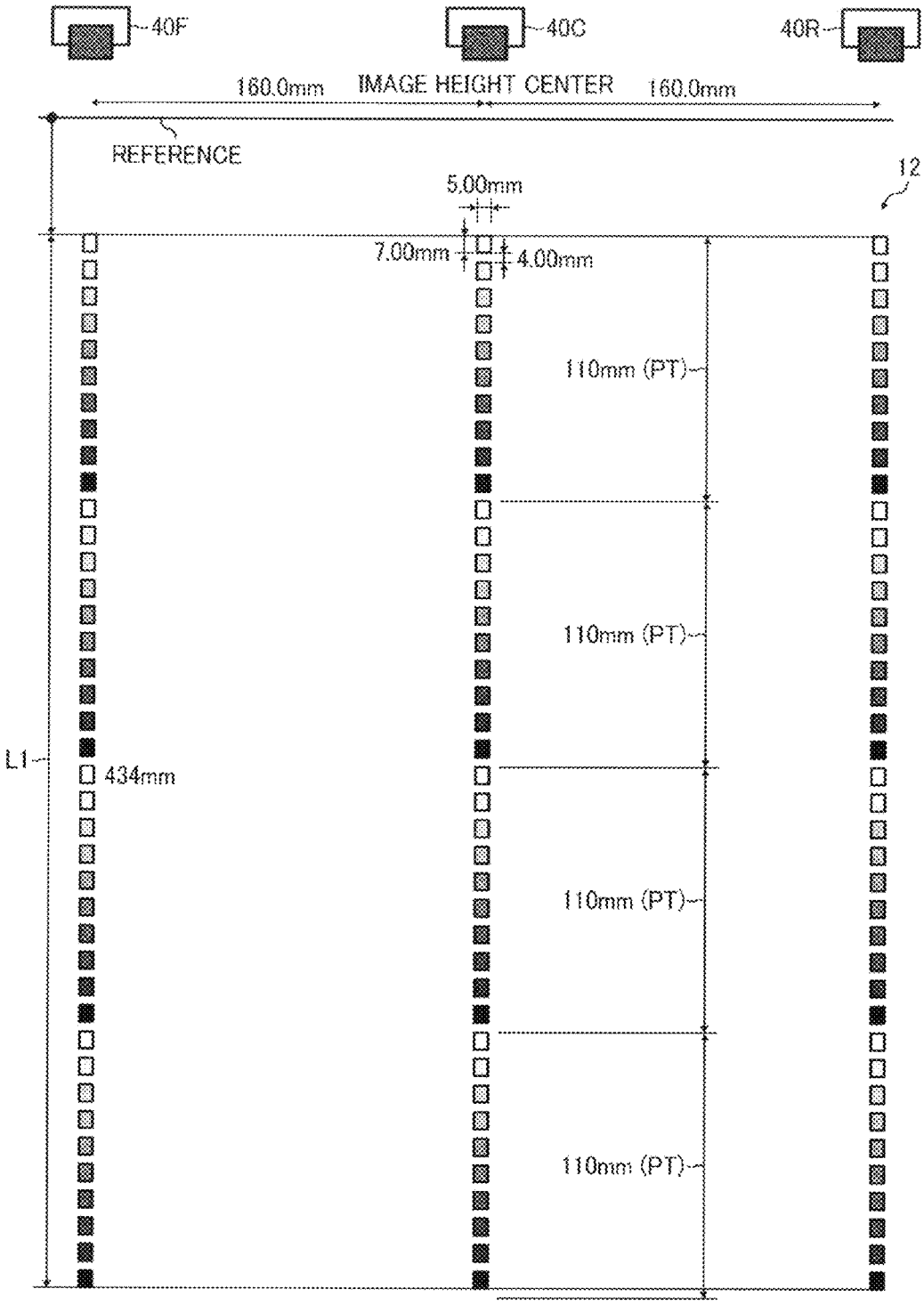
FIG. 4 is a diagram illustrating an example of toner patterns formed during the non-printing period of the image forming apparatus shown in FIG. 1.
Figure 5:
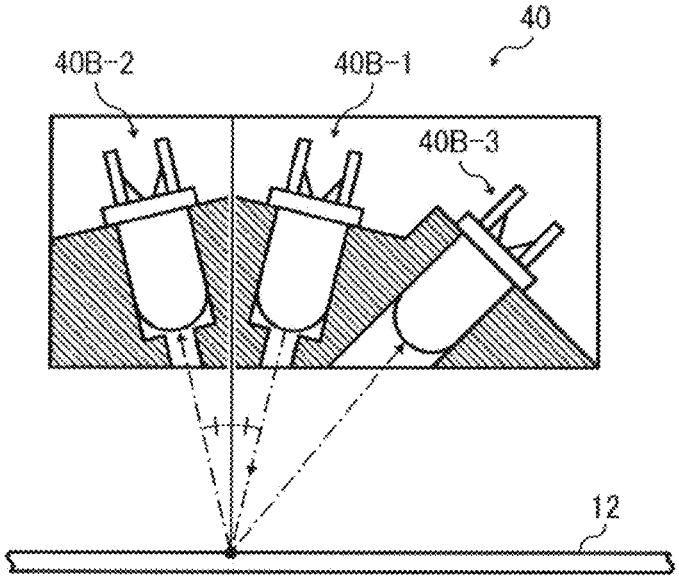
FIG. 5 is a schematic view of a reflection light sensor according to an embodiment, to detect the toner pattern.

It is to be noted that, in FIG. 1, reference numeral 40 collectively represents sensors 40F, 40C, and 40R shown in FIG. 4 to detect reflection density of toner images.

Next, operations to form images on the sheets S are described below.

Initially, image signals are transmitted to a controller 50 of the image forming apparatus 1 from a computer, a scanner, a facsimile machine, or the like. The controller 50 then converts the image signals into output image signals determined by control operations described later and transmits the converted signals to the exposure device 8. The exposure device 8 directs the laser beam emitted from the laser light source, which can be a semiconductor laser, according to image data onto the surface of the photoreceptor 3 charged uniformly by the charging roller 4, thus forming an electrostatic latent image on the photoreceptor 3. The electrostatic latent image is developed into a toner image by the developing device 6, after which the primary-transfer roller 13 primarily transfers the toner image onto the surface of the intermediate transfer belt 12 rotating in synchronization with the photoreceptor 3. The above-described latent image formation, image development, and primary image transfer are performed on the respective photoreceptors 3. Consequently, yellow, cyan, magenta, and black toner images are superimposed one on another on the intermediate transfer belt 12, forming a four-color toner image. The intermediate transfer belt 12 transports the four-color image.

Meanwhile, the sheet S is fed from the sheet tray 23 or 24 to the registration rollers 28 through the paper feeding channel 27. The registration rollers 28 send out the sheet S, timed to coincide with the arrival of the toner image formed on the intermediate transfer belt 12, and the secondary-transfer roller 18 transfers the toner image from the intermediate transfer belt 12 onto the sheet S. Then, the fixing device 31 fixes the toner image on the sheet S (i.e., fixing process), and then the discharge rollers 32 discharge the sheet S carrying the image to the stack portion 29.

In double-side printing, after the fixing process, the sheet S is guided to a reversal conveyance path 36 by switching the position of a switching pawl 38. After the sheet S is reversed, the sheet S is transported again to the registration rollers 28 through a feeding path 37 by switching the position of a switching pawl 39. Thus, the sheet S is turned upside down. At that time, another toner image (i.e., a back side image) is formed on the intermediate transfer belt 12. After the toner image is transferred onto a back side (i.e., a second face) of the sheet S and fixed thereon by the fixing device 31, the sheet S is discharged by the discharge rollers 32 to the stack portion 29.

It is to be noted that, although the descriptions above concern full-color image formation, monochrome images, single-color images, bicolor images, and tricolor images can be formed by similar operations except that one or more of the photoreceptors 3 is not used.

Density control (image quality adjustment) during non-printing period is described below with reference to FIG. 2.

It is to be noted that the term "non-printing period" means a period, such as start-up time after power is turned on, idle running time of the photoreceptor 3 before and after image output, and the like, during which the image forming apparatus 1 does not output images. In image forming apparatuses typically, even if image density is adjusted once, the image density changes over time. Image density tends to deviate when temperature and humidity change inside the image forming apparatus and the image forming apparatus has been left unused for a long time (hereinafter "unused period"). Additionally, image density deviates as the number of sheets output increases. Therefore, image forming condition adjustment timings are preliminarily stored in a memory inside the controller 50. The image forming condition adjustment timings include after an experimentally determined number of sheets are printed, when a temperature and humidity detector inside the image forming apparatus detects a change greater than an experimentally obtained threshold, when the unused period exceeds an experimentally determined threshold.

Figure 2:
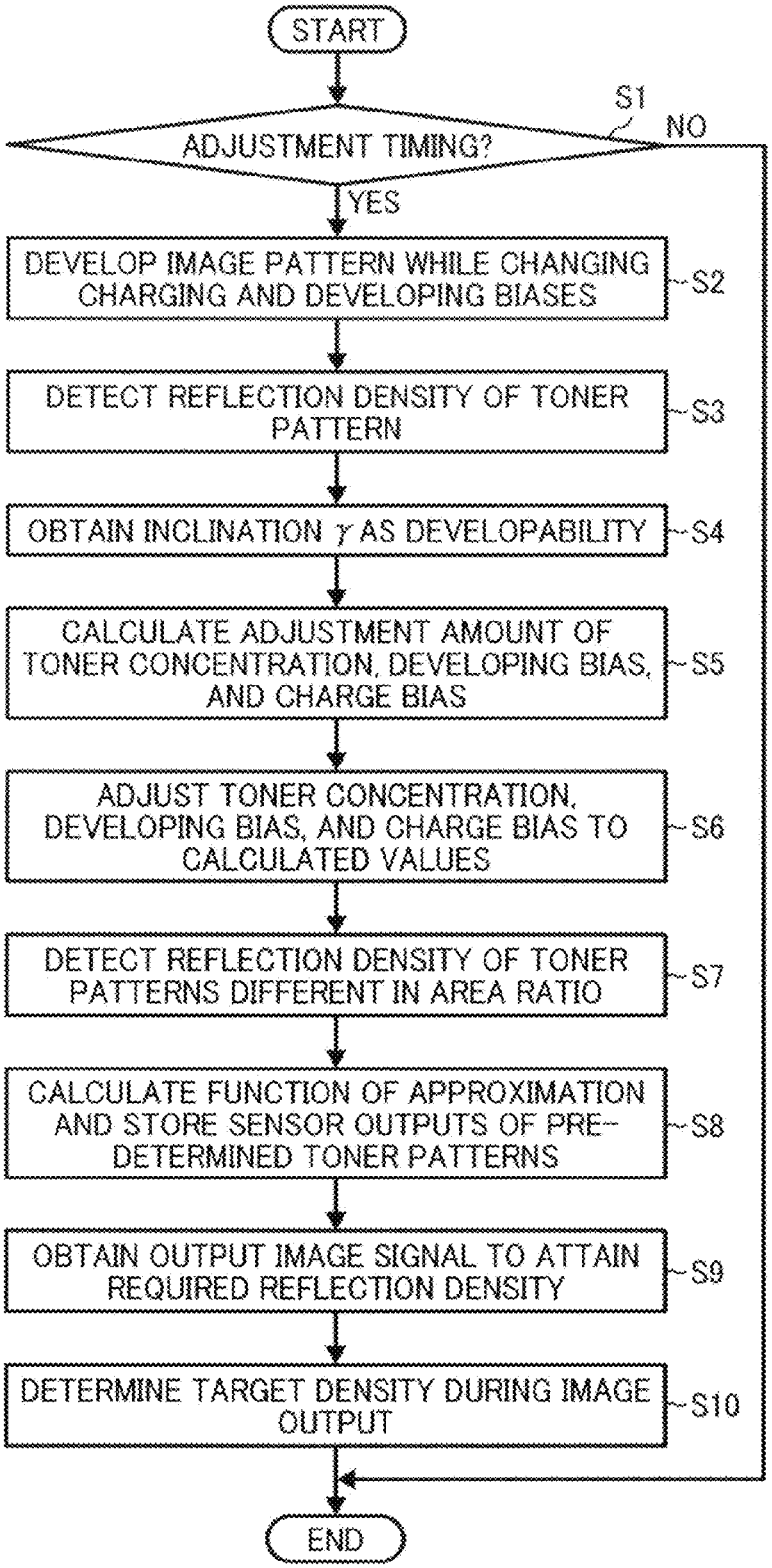
FIG. 2 is a flowchart of density control during a non-printing period of the image forming apparatus shown in FIG. 1.

Referring to FIG. 2, at S1, according to a program stored therein, the controller 50 determines whether or not the image forming apparatus 1 is at the image forming condition adjustment timing.

Figure 3:
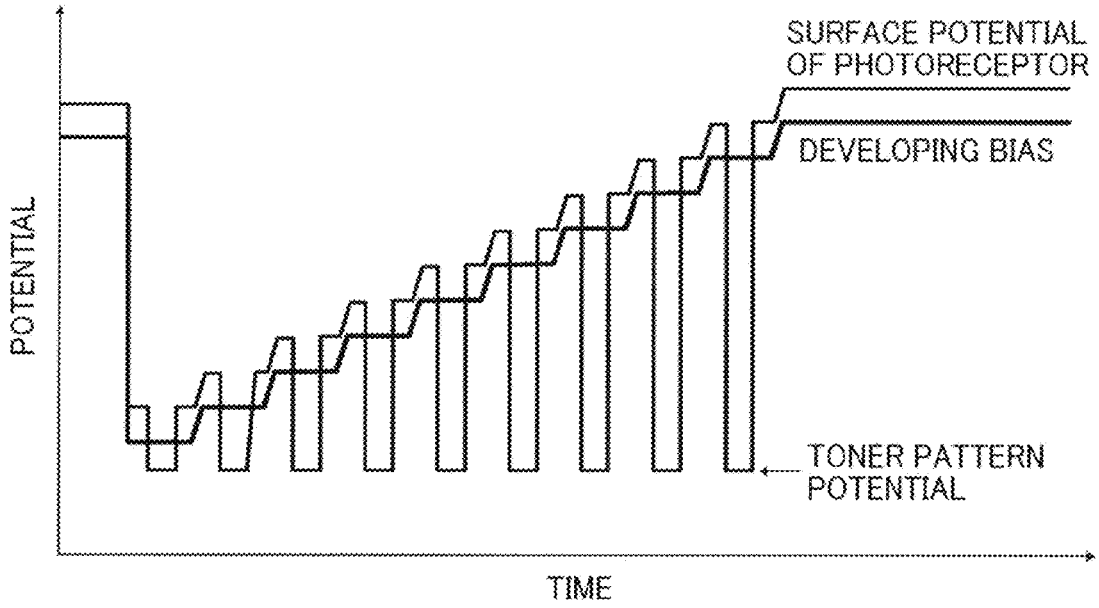
FIG. 3 is a graph illustrating a relation between a toner pattern potential and a developing bias according to an embodiment.

When the apparatus is at the adjustment timing (Yes at S1), a charging bias and a developing bias of the developing device 6 are switched to different values stepwise as shown in FIG. 3. Then, the exposure device 8 forms, for example, a latent image pattern shown in FIG. 4 on the surface of the photoreceptor 3 with full laser lighting. The term "full laser lighting" used here means that, in a range corresponding to the pattern shown in FIG. 4, the laser beam does not form dots but keeps exposing the photoreceptor 3. With such an exposure, the potential of the pattern on the photoreceptor 3 after the exposure is substantially identical as shown in FIG. 3. When the pattern is developed while changing the developing bias stepwise, the amount of toner adhering thereto increases proportionally to the difference between the potential of the pattern and the developing bias.

It is to be noted that, in FIG. 4, reference characters PT represents pits between photoreceptors 3, and L1 represents a full length of a gradation pattern.

Thus, at S2, ten toner patterns different in image density from each other as shown in FIG. 4 are formed on the respective photoreceptors 3. The toner patterns are formed at three positions, namely, front (F), rear (R), and center (C) positions in the direction in which the photoreceptor 3 is scanned with the laser beam (hereinafter "main scanning direction"). That is, the toner patterns are positioned in end portions and a center portion in a direction perpendicular to the direction in which the intermediate transfer belt 12 rotates (i.e., belt travel direction). It is to be noted that hereinafter the toner patterns formed in the end portions and the center portion is referred to as "end pattern" and "center pattern", respectively.

In the configuration shown in FIG. 4, black, cyan, magenta, and yellow toner images are formed in that order from the top in FIG. 4. The amount of toner consumed decreases as the toner pattern decreases in size. In the present embodiment, the toner patterns are rectangular and have a length of 5 mm in the main scanning direction and a length of 7 mm in a sub-scanning direction (i.e., the belt travel direction) perpendicular to the main scanning direction. The charging bias is switched in synchronization with the developing bias because inconveniences such as adhesion of carriers to the photoreceptor 3 arise if the difference between the charging bias and the developing bias is extremely large.

The toner pattern formed on the photoreceptor 3 is transferred by the primary-transfer roller 13 onto the intermediate transfer belt 12. Thus, as shown in FIG. 4, the ten toner patterns for each of the four colors are formed at the front, rear, and center positions on the intermediate transfer belt 12. At S3, reflection densities of the toner patterns are detected using the sensors 40F, 40C, and 40R (also "sensors 40" collectively).

The sensors 40 each include a light-emitting element 40B-1, a specular reflection light sensor 40B-2, and a diffuse reflection light sensor 40B-3. The light-emitting element 40B-1 emits light, which is reflected on the intermediate transfer belt 12. Out of the light thus reflected, specular reflection light is detected by the specular reflection light sensor 40B-2, and diffuse reflection light is detected by the diffuse reflection light sensor 40B-3.

Figure 6:
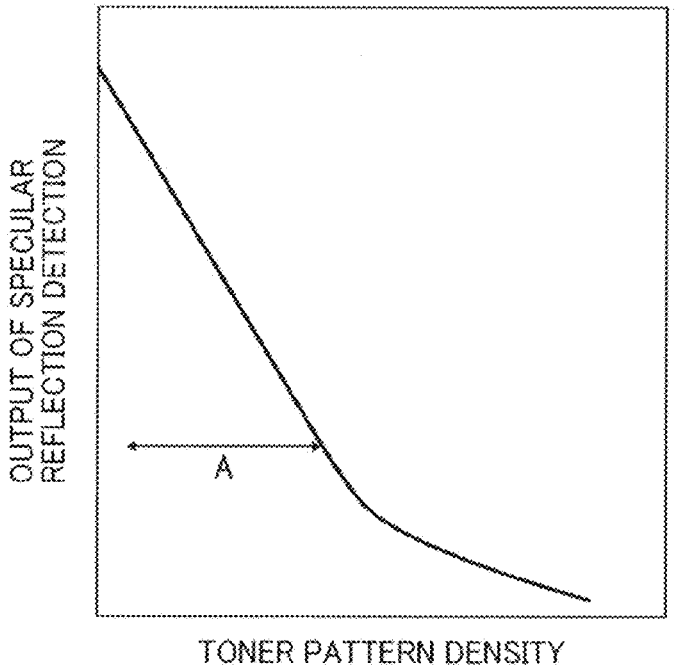
FIG. 6 is a graph illustrating example outputs of specular reflection detection of a black toner pattern.

FIG. 6 is a graph illustrating example outputs of specular reflection detection of the black toner pattern.

In the case of black toner, the density is adjusted using the specular reflection light sensor 40B-2 since the amount of specular reflection light decreases as the amount of toner adhering to the toner pattern (i.e., density) increases as shown in FIG. 6.

Figure 7:
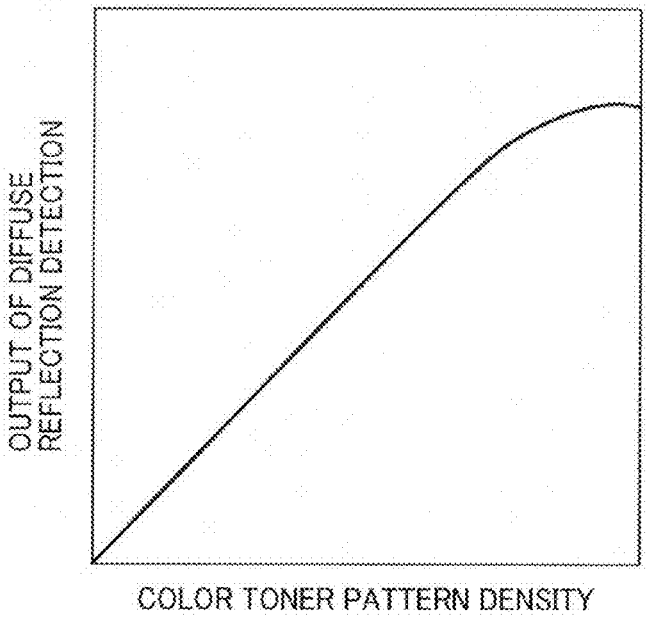
FIG. 7 is a graph illustrating example outputs of diffuse reflection detection of a color toner pattern.

By contrast, outputs from the diffuse reflection light sensor 40B-3 are as shown in FIG. 7, for example. In the case of color toners, the density is adjusted using the diffuse reflection light sensor 40B-3 since the amount of diffuse reflection light increases as the amount of toner adhering to the toner pattern (i.e., density) increases.

Figure 8:
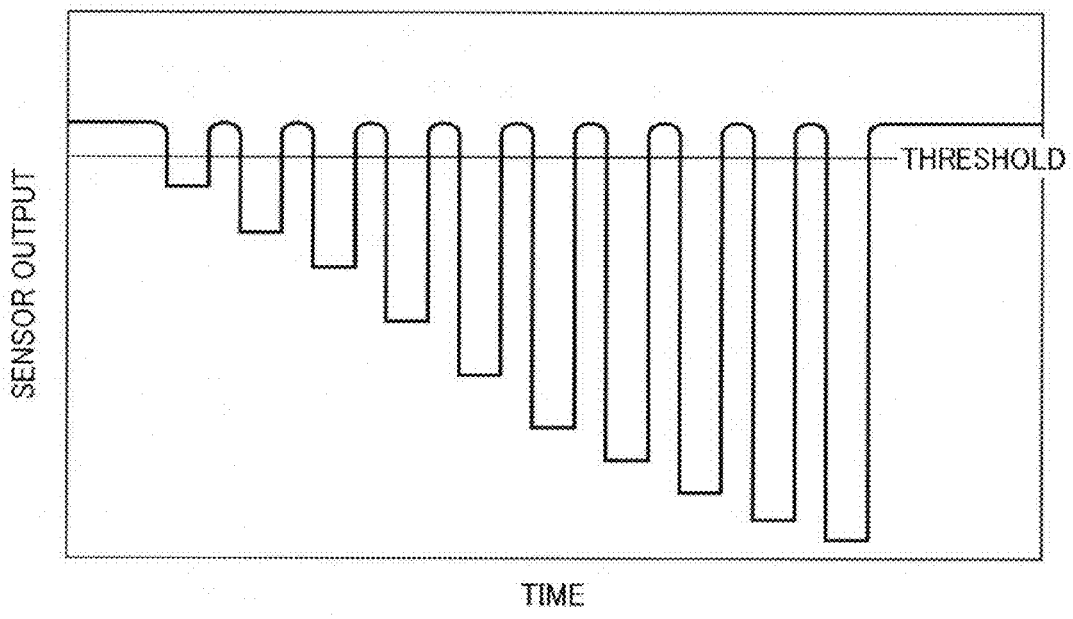
FIG. 8 is a graph illustrating example outputs of a sensor detecting multiple toner patterns.

Then, sensor outputs in the detection of the ten toner patterns are as shown in FIG. 8, for example.

When the toner pattern passes a position vertically under the sensor as the intermediate transfer belt 12 rotates, the sensor outputs changes as shown in FIG. 8 depending on the density of the black toner pattern. Based on the sensor outputs, a threshold to distinguish outputs of toner pattern detection from outputs of detection of backgrounds where no patterns are present is determined. When the sensor output falls below the threshold, it is used as a trigger, and the sensor output corresponding to the position or density of the pattern is identified. Using the timing at which the pattern is written on the first one of the photoreceptors 3Y, 3M, 3C, and 3BK as a trigger, the timing at which the pattern reaches the position vertically under the sensor can be estimated based on the component layout and process linear velocity. Accordingly, the pattern may be read at that timing, but the size of the pattern in this case becomes larger when tolerances are considered.

Alternatively, a certain period prior to the timing at which the pattern reaches the position vertically under the sensor, the light-emitting element 40B-1 may start glowing, sample data consecutively, and identify the pattern using the above-described threshold. This operation is advantageous in that the size of the pattern can be reduced from that used in the method of determining the timings of pattern exposure and reading using the timing based on the component layout. Reduction in the toner pattern size is advantageous in that toner consumption can be reduced. Additionally, it is desirable to reduce the detection range of the sensor 40 to reduce the pattern size. In the present embodiment, the detection range of the sensor 40 is circular and has a diameter of 1 mm, for example, due to the compactness of the light-emitting element and the light-receiving element and layout of slits. The detection range of the sensor 40 is preferably 2 mm or smaller. Although the length of the toner patterns in the present embodiment is 7 mm in the sub-scanning direction, it may be about 5 mm considering the data sample number, accuracy in detecting pattern edges, and the like. The length of the toner patterns in the sub-scanning direction is preferably from about 5 mm to about 7 mm.

Referring back to FIG. 2, at S3, the reflection densities of the respective toner patterns can be known from the outputs of the sensors detecting the toner patterns. In a graph in which the abscissa represents the developing bias and the ordinate represents the reflection density, ten detected values of reflection density relative to the developing bias are plotted, and the ten detected values are approximated into a straight line, thereby obtaining an inclination γ of the straight line. The inclination γ indicates developability of the developing device 6 of each color. The inclination γ can be adjusted by changing the concentration (or density) of toner in developer. The inclination γ can be brought closer to a target by reducing the concentration of toner when it is greater than the target and by increasing the concentration of toner when it is smaller than the target. Even if the inclination γ is not changed, a highest density can be adjusted by changing the developing bias. When the developing bias is increased in absolute value, the amount of toner adhering to the toner pattern increases, and the reflection density of the toner pattern at the highest density increases. By contrast, when the developing bias is reduced in absolute value, the reflection density decreases. When the developing bias is changed, the charging bias is changed in conjunction therewith to maintain a constant difference between the developing bias and the charge potential in non-development areas of the photoreceptor 3 where development with toner is not executed.

In the present embodiment, when the inclination γ is within a predetermined range, the developing bias and the charging bias are changed to attain a target highest reflection density. When the inclination γ deviates from the predetermined range, a control target of the concentration of toner is changed so that the inclination γ falls within the predetermined range. At S5, the amount by which each of the developing bias and the charging bias is changed (hereinafter "adjustment amount") is calculated. The adjustment amount can be calculated easily from an experimentally determined value and the detection result generated by the sensors 40. The relation between the inclination γ and the concentration of toner can be obtained experimentally as well, and, at S5, the adjustment amount of the concentration of toner can be obtained from the experimentally obtained relation and the detected inclination γ. Typically, toner is supplied to adjust the concentration of toner in developer (or density of toner) inside the developing device 6 to a target value according to outputs from a toner concentration sensor (or toner density sensor). When the target value to which the concentration of toner is adjusted is determined, the control target of the toner concentration sensor is changed, and the concentration of toner is adjusted thereto at S6. Further, the developing bias and the charging bias are adjusted to the calculated values. With the above-described control operation, density fluctuations over time and those caused by environmental changes can be corrected.

Figure 9:
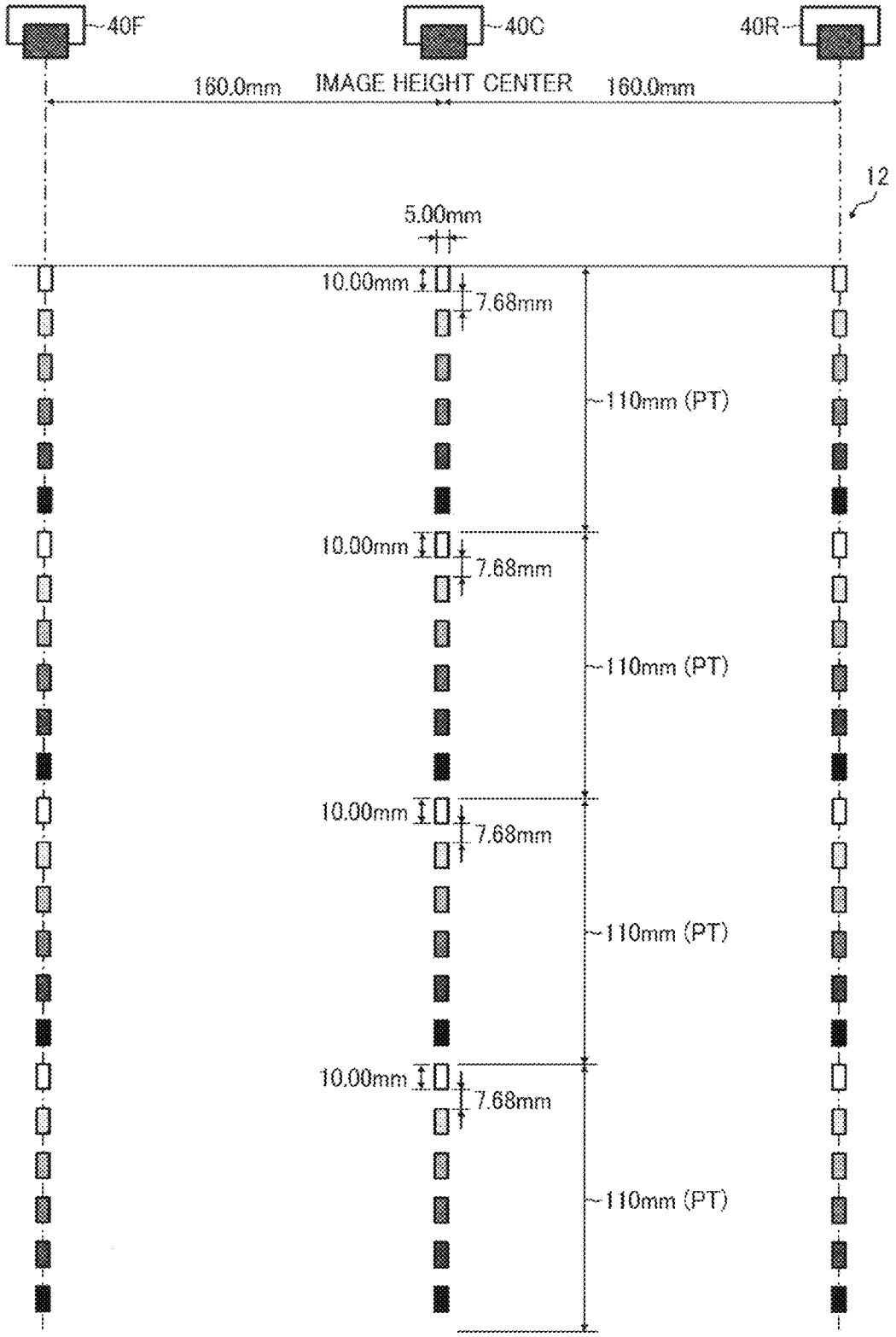
FIG. 9 is a diagram illustrating toner patterns formed during the non-printing period according to an embodiment.
Figure 10A:
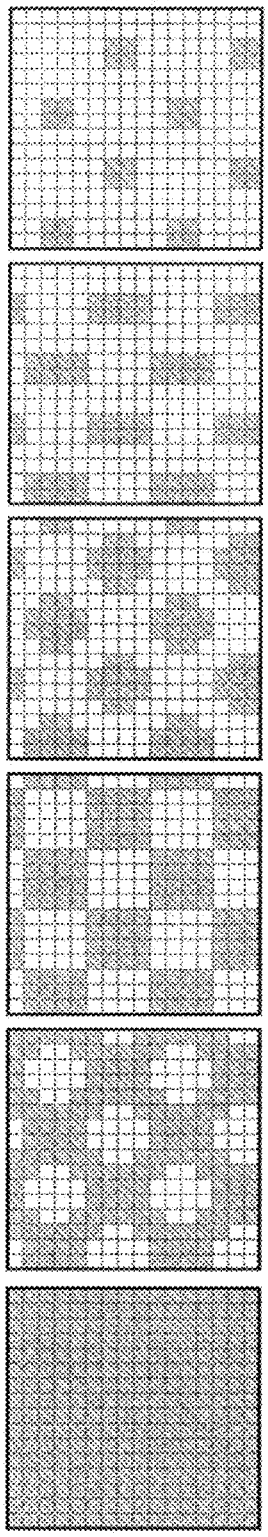
FIGS. 10A and 10B illustrate arrangement examples of toner patterns different in dot area ratios according to an embodiment.
Figure 10B:
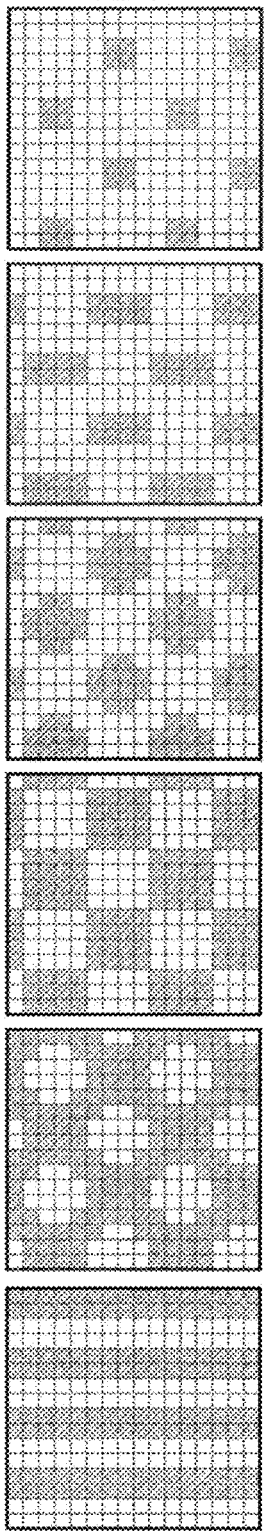

Subsequently, dot patterns, such as those shown in FIG. 9, are formed. The dot patterns are constituted of dots as shown in FIGS. 10A and 10B, and the area ratios thereof are different. In the configuration shown in FIG. 9, six patterns are formed for each of black, cyan, magenta, and yellow in that order from the top in FIG. 9. In digital image forming apparatuses, halftone density is expressed by the percentage of dots per unit area, that is, dot area ratio. By changing the dot area ratio, low density, halftone density, and high density can be expressed. It is possible that changes in the sensitivity of the photoreceptor 3 or the like causes fluctuations in halftone density constructed of dots even when the photoreceptor 3 is exposed with full laser lighting. To correct the fluctuation, multiple toner patterns constructed of dot patterns different in dot area ratio are formed on the intermediate transfer belt 12 with the charging output, the developing bias, and the exposure conditions kept similar to those in normal image output.

Then, the toner patterns are detected by the sensor 40 at S7 (in FIG. 2). To change the dot area ratio, there are two conceivable approaches: increasing the number of dots while dispersing small dots; and localizing the dots to gradually increase the size of the dot pattern. In the present embodiment, the latter is employed since reliability against noises such as jitter is higher in this approach.

FIG. 10A illustrates cyan dot patterns in vertical arrangement, and FIG. 10B illustrates black dot patterns in vertical arrangement.

The dots increase in size or area ratio downward in FIGS. 10A and 10B. The cyan dot area ratios are 12.5%, 25.0%, 37.5%, 50.0%, 62.5%, and 100% from above. The black dot area ratios are 12.5%, 25.0%, 37.5%, 50.0%, 62.5%, and 50% from above.

The dot patterns different in dot area ratio correspond to the output image signals. From the sensor outputs, the reflection densities of the dot patterns are obtained, and, on a graph in which the abscissa represents output image signals and the vertical axis represents the reflection density of the dot pattern, a function of approximation is calculated at S8. Simultaneously, at S8, outputs of the sensor detecting predetermined toner patterns are stored in the controller 50. Specifically, the density of the black dot pattern whose dot area ratio is 50% and the densities of the yellow, magenta, and cyan, dot patterns whose dot area ratio is 100% are stored in the controller 50. At S9, using the calculated function of approximation, the output image signal (dot area ratio) required to output the reflection density instructed by the signal input from the computer or the like can be obtained. Therefore, at S9, according to the input image signal, the output image signal required to attain the density instructed by the input image signal can be determined.

At S10, the controller 50 determines the target density for density control performed while images are output (hereinafter "density control during printing"). The target density of the end pattern in the density control during printing can be calculated using formula 1 below. The density control during printing is described later in further detail.

$$X=H\times J/I \qquad \text{Formula 1}$$

wherein X represent the target density of the end pattern formed during printing, H represents a mean detected density of the end patterns formed during the non-printing period, J represents a predetermined reference value, and I represents a mean values of detected densities of the center pattern and the end patterns formed during the non-printing period (hereinafter "mean detected density I").

The detected densities of the dot patterns formed in the end portions during the non-printing period mean the detected densities of the black dot pattern whose dot area ratio is 50% and color dot patterns whose dot area ratio is 100%, detected by the sensors 40F and 40R shown in FIG. 9 and stored at S8 shown in FIG. 2. Similarly, the detected densities of he dot patterns formed in the center portion during the non-printing period mean the detected densities of the black dot pattern whose dot area ratio is 50% and color dot patterns whose dot area ratio is 100%, detected by the sensors 40C shown in FIG. 9 and stored at S8 shown in FIG. 2. The predetermined reference value J is a value preset (fixed value) for each color and indicates a mean target density of the toner patterns formed at front, rear, and center positions. In the present embodiment, for example, the predetermined reference value J is 0.4 mg/cm$^2$.

When the mean detected density H as is used as the target density X of the end patterns in density control during printing, the target density X may be extremely small or extremely large when there are differences in density between the image area and portions outside thereof. Therefore, in that case, the mean detected density H is corrected using formula 1. Specifically, the mean detected density H is multiplied by J/I, and the value thus obtained is used as the target density X.

The target density X is determined according to formula 1 from the following reasons.

In the density control during printing, detection and adjustment are executed only at the ends of the image area in the main scanning direction. By contrast, during the non-printing period, the density is determined entirely in the three portions including the center portion. In the case in which the density is proper, even if the density in the end portions is lower to a certain degree, it is tolerable. However, when the density in the center portion is too high, inconveniences arise if the target density in the end portions is set to the value detected at that time. That is, it is possible that the entire density is made too low consequently.

In the image quality adjustment (density control) during non-printing period, if the developability is low and the image forming conditions (image portion potential in particular) are set to the upper limits, the desired density is not attained, and toner images become too light. In that case, in the image quality adjustment during printing, it is necessary to detect that the toner image is too light and to attain the desired density by enhancing the developability and lowering the image portion potential.

However, it fails to detect that the toner image is too light if the detected value is always used as the target value during non-printing period. Then, the image density is kept at the lighter density. Accordingly, when the value detected in the image quality adjustment during non-printing period is not proper, it is necessary to adjust the detected value at the time of setting the target density of the end pattern during printing.

For example, it is conceivable that the density is proper at the completion of image quality adjustment during non-printing period in the cases shown in table 1.

In cases A, B, and C shown in table 1, the mean detected density I of toner patterns at the front (F), rear (R), and center (C) positions coincides with the predetermined reference value J, which is the mean target density of toner patterns at the three positions (I=J).

As described above, the predetermined reference value J is 0.4 mg/cm$^2$. In cases A, B, and C shown in table 1, the mean detected density I is 0.4 and identical to the predetermined reference value J. Thus, the density is proper. For example, in case A, the mean detected density H of the two positions is 0.4. Accordingly, the target density X of the end patterns at the two positions is 0.4. Since the mean detected density H equals to the target density X (H=X), the mean detected density H, which is the detected value, is not varied in the adjustment. In other words, the image density in non-printing period is maintained in formation of end patterns in density control during printing. Similarly, when the mean detected density H is 0.3 and 0.5, the target density X is 0.3 and 0.5, respectively.

TABLE 1

| Case | Mean detected density H ($mg/cm^2$) | Mean detected density I ($mg/cm^2$) | Predetermined reference value J ($mg/cm^2$) | Target density X of end patterns during printing |
|---|---|---|---|---|
| A | 0.4 | 0.4 | 0.4 | 0.4 |
| B | 0.3 | 0.4 | 0.4 | 0.3 |
| C | 0.5 | 0.4 | 0.4 | 0.5 |

Additionally, the predetermined reference value J is 0.4 $mg/cm^2$ even when the mean value of detected densities of end patterns during non-printing period is lower and thus the density at the end position is low.

For example, it is conceivable that the density is not proper at the completion of image quality adjustment during non-printing period in the cases shown in table 2.

In cases D through G shown in table 2, the mean detected density I of toner patterns at the three positions, the front (F), rear (R), and center (C) positions, does not coincide with the predetermined reference value J, which is the mean target density of toner patterns at the three positions ($I \neq J$).

For example, in case D, although the predetermined reference value J is 0.4, the mean detected density I of the three positions is 0.3, and the mean detected density H of the two positions is 0.3. Then, according to formula 1, the target density X of the end patterns at the two positions is 0.4. Since the mean detected density H is not equal to the target density X ($H \neq X$), the mean detected density H, which is the detected value, is corrected to 0.4 in the adjustment.

Further, in case G, although the predetermined reference value J is 0.4, the mean detected density I of the three positions is 0.45, and the mean detected density H of the two positions is 0.5. Accordingly, the target density X of the end patterns at the two positions is 0.444. Thus, the mean detected density H is not equal to the target density X ($H \neq X$), and the mean detected density H, which is the detected value, is corrected toward 0.4 in the adjustment.

That is, it can be detected that the image density during non-printing period is low when the mean detected density H is smaller than the target density X ($H<X$), and it can be detected that the image density during non-printing period is high when the mean detected density H is greater than the target density X ($H>X$). Therefore, the image density can be adjusted (increased or reduced) in the image quality adjustment during printing.

TABLE 2

| Case | Mean detected density H ($mg/cm^2$) | Mean detected density I ($mg/cm^2$) | Predetermined reference value J ($mg/cm^2$) | Target density X of end patterns during printing |
|---|---|---|---|---|
| D | 0.3 | 0.3 | 0.4 | 0.4 |
| E | 0.5 | 0.5 | 0.4 | 0.4 |
| F | 0.3 | 0.35 | 0.4 | 0.342 |
| G | 0.5 | 0.45 | 0.4 | 0.444 |

Next, descriptions are given below of density control during printing with reference to FIGS. 11 and 12.

It is to be noted that the term "during printing" means that the period during which the image forming apparatus 1 outputs images. Although the toner patterns may be detected constantly during printing, significant changes in density are rather rare. Additionally, it is preferred to save toner. Accordingly, it is recommended to set the image forming condition adjustment timing (timing of toner pattern formation and density adjustment) to each time an image formation variable, such as, the number of output sheets, the run time of the image forming apparatus 1, and the travel distance of the photoreceptor 3 or the developing roller 5, reaches a threshold.

Figure 11:
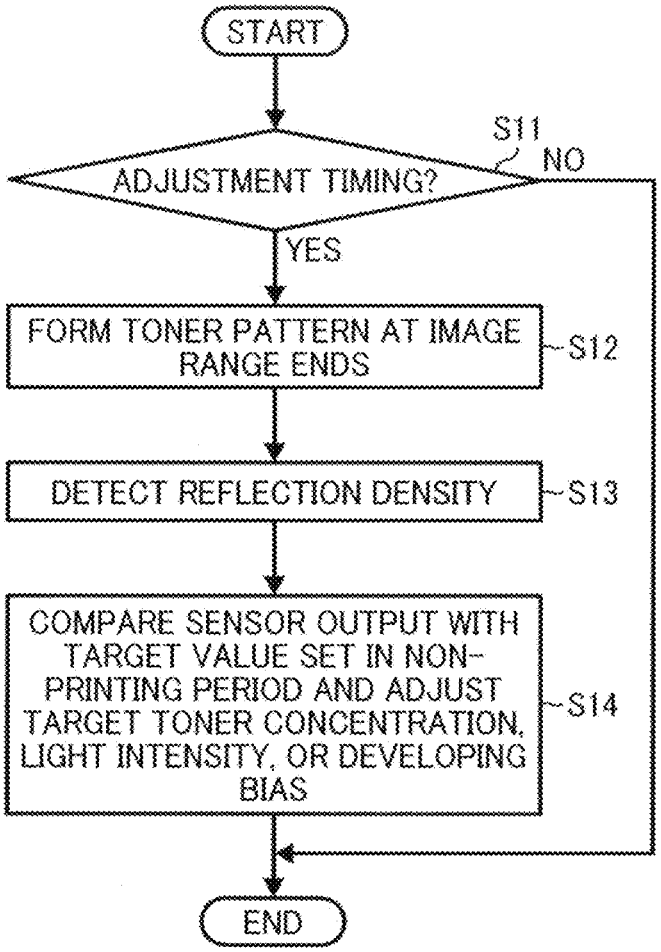
FIG. 11 is a flowchart of density control during printing of the image forming apparatus shown in FIG. 1.

Referring to FIG. 11, at S11, the controller 50 determines whether or not the image forming apparatus 1 is at such an image forming condition adjustment timing.

Figure 12:
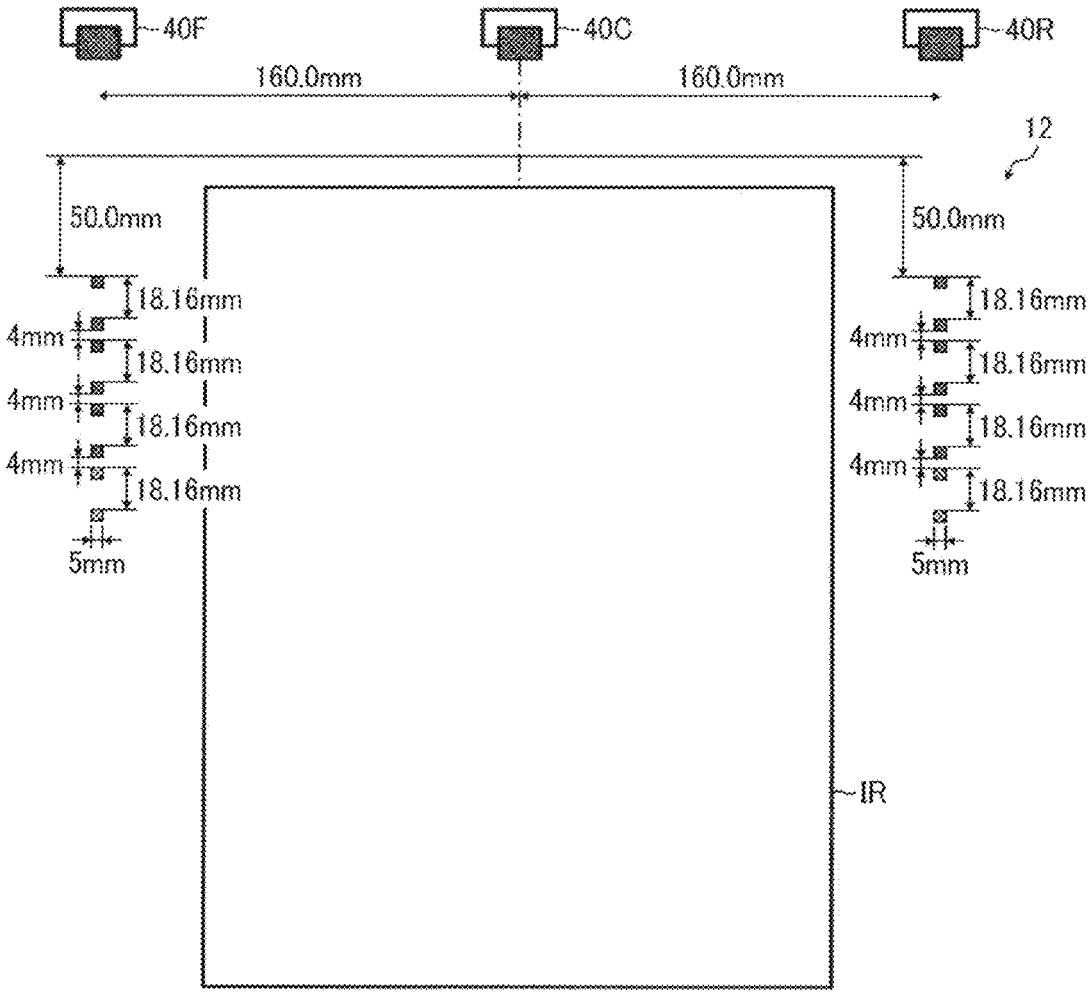
FIG. 12 is a diagram illustrating an example of toner patterns formed during the printing period.

Determining that the apparatus is at adjustment timing (Yes at S11), at S12, the controller 50 instructs formation of the end patterns outside an image area IR of the intermediate transfer belt 12 as shown in FIG. 12, more specifically, in the end portion in the main scanning direction, in addition to formation of images in the image area IR. The number of toner image formed here is smaller than that in the density control during non-printing period. The patterns formed here are selected preliminarily from those formed in the density control during non-printing period and identical to those for calculation of the target density X in the flowchart of the density control during non-printing period shown in FIG. 2. When the identical patterns are used, the state of the image forming apparatus 1 immediately after adjustment of developing bias in the density control during non-printing period can be maintained easier than in the case in which different toner patterns are used.

Figure 13:
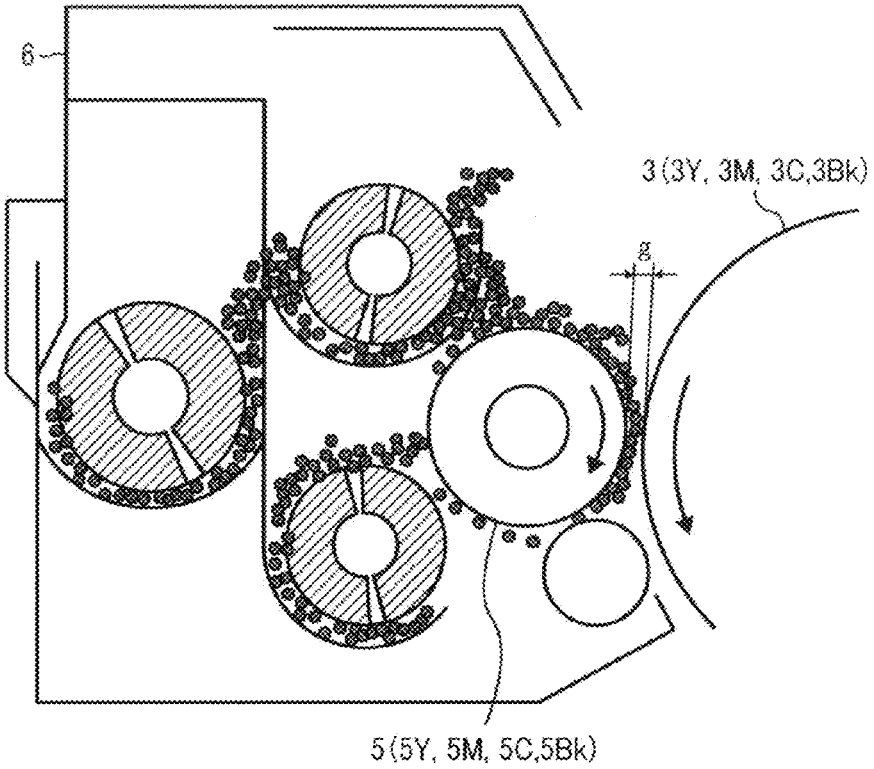
FIG. 13 is a cross-sectional view of a developing device of the image forming apparatus shown in FIG. 1.

Additionally, in the end patterns shown in FIG. 12, two identical patterns are formed for each color at an interval equal to or similar to a half-turn distance or a half circumferential length (for example, 18.16 mm in FIG. 12) of the developing roller 5. Securing such an interval between toner patterns attains the following advantage. Referring to FIG. 13, a gap g is present between the developing roller 5 and the photoreceptor 3, and the gap g fluctuates due to runout of the developing roller 5. For example, the gap g fluctuates when the center of rotation of the developing roller 5 deviates from an intended position. The fluctuations in the gap g cause the density to fluctuate as shown in FIG. 14.

Figure 14:
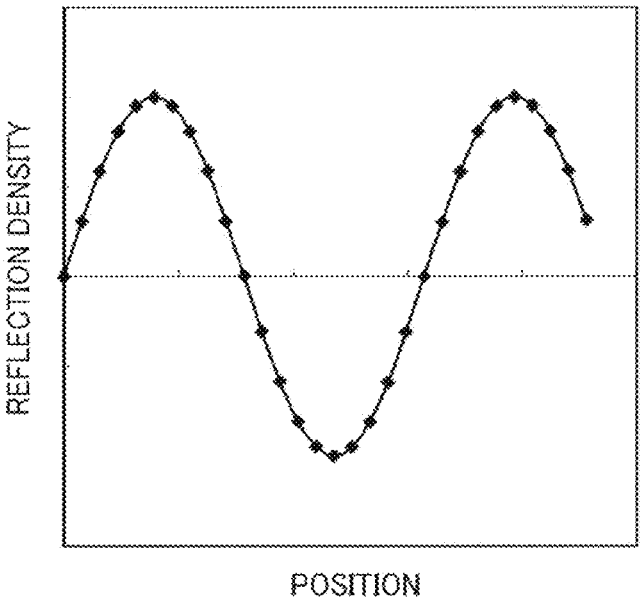
FIG. 14 is a graph of fluctuations in density caused by fluctuations of a developing roller of the developing device shown in FIG. 13.

FIG. 14 is a graph illustrating fluctuations in reflection density observed when toner patterns having a constant surface potential are developed with the developing bias kept constant.

In FIG. 14, the ordinate represents deviations from a mean reflection density, and the abscissa represents the position of the toner pattern in the direction in which the photoreceptor 3 rotates. In theory, the reflection density should be constant since a constant developing bias is applied to a constant potential. However, the reflection density fluctuates as shown in FIG. 14 due to the fluctuation in the gap g. When such density fluctuations are present, it is possible that adjustment using a smaller number of toner patterns makes the density control unreliable. If the developing roller 5 is produced with a higher degree of precision, this inconvenience may be prevented. However, the need for such a high precision can be obviated in the present embodiment. That is, density fluctuations can be canceled by securing the interval of about the half-turn distance of the developing roller 5 between the toner patterns as in the present embodiment.

Figure 15:
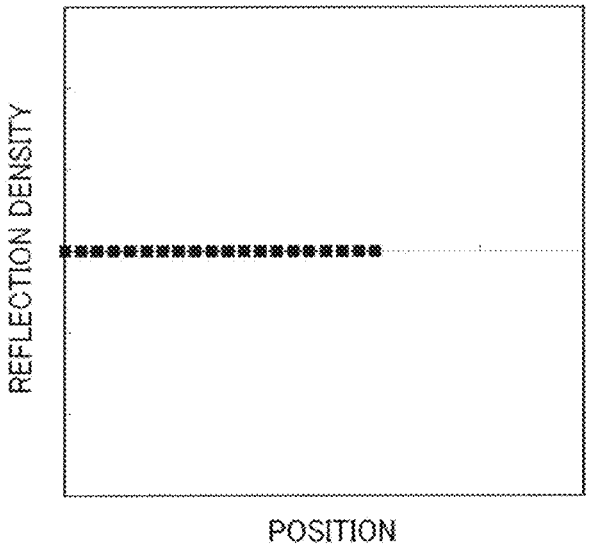
FIG. 15 is a graph illustrating mean densities of two patterns shifted by about a half-turn distance of the developing roller while density fluctuations arise.

FIG. 15 is a graph illustrating mean densities at two points (that is, two patterns of same color in FIG. 12) shifted by a half cycle on the sine curve when the density fluctuation drawing the sine curve shown in FIG. 14 is present.

As shown in FIG. 15, the density fluctuation is canceled. Thus, when identical toner patterns are formed at positions shifted by about the half-turn distance of the developing roller 5 and taking the mean density thereof, the density fluctuation resulting from the runout of the developing roller 5 can be canceled, thus making the density control reliable.

Additionally, in FIG. 12, the black end pattern, which is the lowest among the four colors, is a halftone density pattern. In particular, the black end pattern is the black dot pattern whose dot area ratio is 50%. The reason for use of such a pattern can be known from FIG. 6 indicating characteristics of output from the specular reflection sensor detecting black toner. That is, in the area where the density (reflection density) of the toner pattern is higher, changes in sensor output in response to changes in density are smaller, and thus the sensitivity is degraded. Accordingly, it is preferred that the toner pattern density in density control during printing be set in the range A of halftone density, where the sensor output changes sensitively in response to the changes in toner pattern density. In the range A, the dot area ratio is about 70% or smaller. Additionally, the toner pattern density is preferably high to secure the maximum density. Accordingly, the lower limit of the toner pattern density is set to 30%.

Figure 16A:
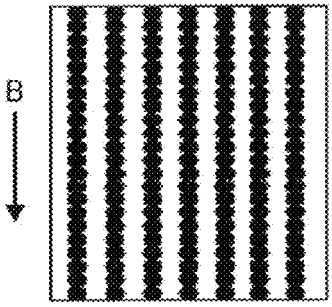
FIGS. 16A, 16B, and 16C are diagrams illustrating examples of dot arrangement of a black halftone density pattern.
Figure 16B:
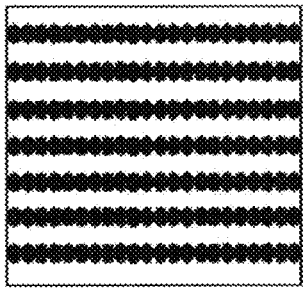
Figure 16C:
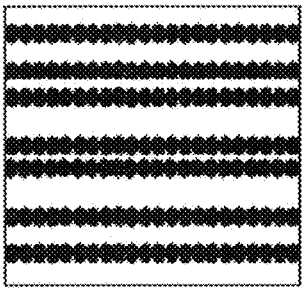

Further, referring to FIG. 16A, the black dot patterns of halftone density shown in FIG. 12 is preferably formed of dots linearly arranged in the sub-scanning direction (arrow B in FIG. 16A), in which the intermediate transfer belt 12 moves. If the dots are arranged in the main scanning direction as shown in FIG. 16B, fluctuations in the linear velocity of the intermediate transfer belt 12 cause fluctuations in the positions of the dots as shown in FIG. 16C, and the density become unstable. Dot pattern arrangement can be easily created when the pattern image data is stored in the controller 50.

Referring back to FIG. 11, the toner patterns thus formed pass under the sensors 40F and 40R, and the reflection densities thereof are detected at S13. Data sampling at that time is similar to the above-described reading of toner patterns formed with full laser lighting. Specifically, using the pattern writing timing, the timing at which the pattern reaches the position vertically under the sensor can be estimated based on the component layout and process linear velocity. Therefore, the light-emitting element 40B-1 is turned on slightly prior to that timing. The sensor output detecting the position or density of the pattern is identified from the position at which the detected value falls below the predetermined threshold.

Subsequently, in the present embodiment, a mean density of two identical dot pattern shown in FIG. 12 is calculated. At S14, the reflection density indicated by the sensor output (i.e., detected reflection density) is compared with the target density X determined in the density control during non-printing period, and one of the image forming conditions including the target toner concentration, the amount of light, and the developing bias is adjusted. When the detected reflection density is lower than the target density X, one of the target toner concentration, the amount of light, and the absolute value of the developing bias is increased. By contrast, when the detected reflection density is higher than the target density X, one of these variables is reduced. The amount by which the variable is changed can be determined experimentally for individual image forming apparatuses. Since the amount of writing light can be changed quickly compared with the concentration of toner, the amount of light is changed in the present embodiment.

In the above-described embodiment, multiple toner patterns are formed and image forming conditions are set with a higher degree of accuracy in non-printing period, whereas, during printing, a smaller number of end patterns are formed and detected in parallel to formation of output images, thus executing density control while keeping the state similar to that of non-printing period. Therefore, images can be kept stable longer than in a case in which the density control is executed only in non-printing period. Additionally, the density adjustment can be finer than that in a case in which only the density control during printing is executed.

It is to be noted that, in FIG. 12, although the end patterns are formed in addition to the output images, formation of the end patterns may be omitted when the sheet size is large. To form the end patterns in the non-image area in parallel to formation of output images in the image area IR on largest size sheets, it is required to make the width of the intermediate transfer belt 12 greater than largest size sheets, thus making the image forming apparatus 1 bulkier. In addition, it is relatively rare that users use largest size sheets. Therefore, the density control during printing can be executed when smaller sheets are used and omitted when largest size sheets are used.

Further, when the density control during printing is executed similarly while images are formed on the largest size sheet in the apparatus according to the present embodiment, the secondary-transfer roller 18 can be designed such that the width of the secondary-transfer roller 18 corresponds to the largest size sheet and the end patterns on the intermediate transfer belt 12 do not contact the secondary-transfer roller 18. This configuration can obviate the need of disengaging the secondary-transfer roller 18 from the intermediate transfer belt 12 since the end patterns do not contact the secondary-transfer roller 18. It is to be noted that the image forming apparatus 1 further includes a shifting unit to disengage the secondary-transfer roller 18 in the density control during non-printing period so that the secondary-transfer roller 18 do not contact the toner patterns.

If users desire to use larger sheets S in an image forming apparatus in which the secondary-transfer roller 18 is shorter in width than the intermediate transfer belt 12 so that the end patterns do not contact the secondary-transfer roller 18 during printing, the secondary-transfer roller 18 may be replaced with a wider secondary-transfer roller to enable use of larger sheet size extending into the range where the end patterns are formed. In this case, formation of toner patterns in the density control during printing is prohibited to protect the secondary-transfer roller from stains.

Figure 17:
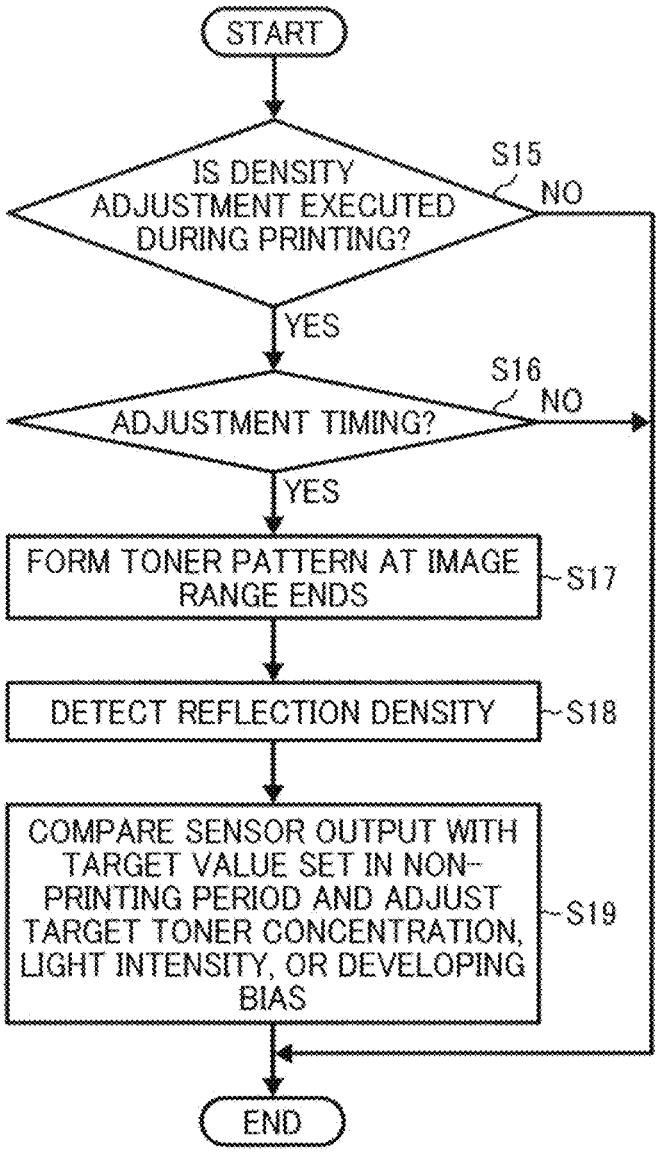
FIG. 17 is a flowchart of control procedure including prohibition of density control during printing.

FIG. 17 is a flowchart of a procedure in which the program of the controller 50 includes prohibition of the density control during printing in view of sheet size change, in particular, use of the largest size sheet.

As shown in FIG. 17, as S15 the controller 50 determines whether to execute the density control during printing. Enabling and disabling of the density control during printing may be instructed by the user using the control panel 100 of the image forming apparatus 1 or included in a drive program of the image forming apparatus 1 installed in computers or the like. When the density control during printing is executed (Yes at S15), similar to the flowchart shown in FIG. 11, at S16 the controller 50 determines whether or not the image forming apparatus 1 is at the image forming condition adjustment timing. The end patterns are formed at S17, and the reflection density is detected at S18. At S19, at least one of the target toner concentration, the amount of light, and the developing bias is adjusted. When the density control during printing is not executed (No at S15), the control operation is completed.

As described above, in the description above, differences in density between toner images in the image area and those in the non-image area are detected, and image forming conditions of the toner image forming unit are adjusted according to the detection result. With this operation, the image density can be adjusted to the target density in the method of forming the toner patterns inside and outside the image area.

It is to be noted that, although the intermediate transfer belt serves as the image bearer in the above-described embodiment, the apparatus to which the aspects of this specification are applicable is not limited to image forming apparatuses employing the intermediate transfer belt. For example, the intermediate transfer member may be an intermediate transfer drum. Alternatively, the aspects of this specification are applicable to image forming apparatuses employing a direct transfer belt on which sheets are transported to transfer toner images thereto from the photoreceptors. Yet alternatively, the above-described control operation may be executed by detecting toner patterns formed on the photoreceptor. In this case, the image bearer is the photoreceptor, and the photoreceptor is excluded from the toner image forming unit. The toner image forming unit is constructed of devices to form toner images on the photoreceptor.

It is to be noted that, the aforementioned density control may be embodied in the form of an apparatus, method, system, computer program and computer program product, including, but not limited to, any of the structure for performing the methodology illustrated in the drawings. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform any of the above mentioned control procedures.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer;

a toner image forming unit including a developing device provided with a developing roller;

a detector to detect a toner pattern formed on the image bearer; and a controller to cause the toner image forming unit to form the toner pattern on the image bearer, cause the detector to detect the toner pattern, and adjust an image forming condition of the toner image forming unit based on a detection result generated by the detector, wherein during a non-printing period, the toner image forming unit forms multiple toner patterns and the detector detects densities of the multiple toner patterns, during a printing period, the toner image forming unit forms an output image in an image area and toner patterns in a non-image area, the toner patterns being smaller in number than the multiple toner patterns formed during the non-printing period and being selected from the multiple toner patterns formed during the non-printing period, and the detector detects densities of the smaller number of toner patterns, the multiple toner patterns formed during the non-printing period are formed in both an end portion and a center portion of the image bearer in a direction perpendicular to a direction in which the image bearer moves, the smaller number of toner patterns formed during the printing period are formed in the end portion of the image bearer, the controller determines a target density X of the smaller number of toner patterns formed during the printing period using a formula:

$$X=H\times J/I$$

wherein H represents a first mean detected density of the multiple toner patterns formed in the end portion during the non-printing period, J represents a predetermined reference value, and I represents a second mean detected density of the multiple toner patterns formed in the end portion and the multiple toner patterns formed in the center portion during the non-printing period, and the toner patterns formed in the end portion of the image bearer during the printing period are smaller in number than the multiple toner patterns formed in the end portion of the image bearer during the non-printing period.

2. The image forming apparatus according to claim 1, wherein the smaller number of toner patterns formed during the printing period are positioned at an interval of approximately a half-turn distance of the developing roller.

3. The image forming apparatus according to claim 1, wherein the smaller number of toner patterns comprise a black halftone density pattern.

4. The image forming apparatus according to claim 3, wherein the black halftone density pattern is constructed of dots and has a dot area ratio from 30% to 70%.

5. The image forming apparatus according to claim 4, wherein the black halftone density pattern is constructed of dots arranged linearly in the direction in which the image bearer moves.

6. The image forming apparatus according to claim 1, wherein the toner pattern has a length from 5 mm to 7 mm in the direction in which the image bearer moves.

7. The image forming apparatus according to claim 1, wherein the toner image forming unit further comprises an exposure device, the multiple toner patterns formed during the non-printing period comprise:

multiple different patterns formed with the exposure device set to full lighting and a developing bias of the developing device switched among multiple values; and multiple dot patterns different in dot area ratio, and the smaller number of toner patterns formed during the printing period are selected from the multiple dot patterns different in dot area ratio.

8. The image forming apparatus according to claim 1, wherein the controller determines not to form the smaller number of toner patterns during the printing period depending on a size of a recording medium on which the output image is formed.

9. The image forming apparatus according to claim 1, further comprises an input device via which a user or a service person inhibits formation of the smaller number of toner patterns during the printing period.

10. The image forming apparatus according to claim 1, wherein when the first mean detected density H is less than the determined target density X, the first mean detected density H is corrected by increasing a value of the first mean detected density H.

11. The image forming apparatus according to claim 1, wherein when the first mean detected density H is greater than the determined target density X, the first mean detected density H is corrected by decreasing a value of the first mean detected density H.

* * * * *